US007216461B1

(12) United States Patent
Clemmer

(10) Patent No.: US 7,216,461 B1
(45) Date of Patent: May 15, 2007

(54) SYSTEM AND METHOD FOR FORMING SURFACES USING TILED COMPONENTS AND PRODUCT RESULTING THEREFROM

(76) Inventor: Clay E. Clemmer, 5851 FM 2727, Kaufman, TX (US) 75142

( * ) Notice: Subject to any disclaimer, the term of this patent is extended or adjusted under 35 U.S.C. 154(b) by 536 days.

(21) Appl. No.: 10/222,327

(22) Filed: Aug. 16, 2002

(51) Int. Cl.
*E04F 11/16* (2006.01)
*E04F 15/00* (2006.01)

(52) U.S. Cl. ..... 52/177; 52/385; 52/386; 52/391; 52/747.11; 52/591.4

(58) Field of Classification Search ..... 52/177, 52/384, 385, 386, 390, 391, 392, 747.11, 52/745.05, 749.11, 591.4, 389; 428/45, 52, 428/53, 55, 194; 156/297, 299, 71
See application file for complete search history.

(56) References Cited

U.S. PATENT DOCUMENTS 3,444,660 A * 5/1969 Feichter et al. ..... 52/389
4,621,001 A * 11/1986 Bard ..... 428/49
5,401,343 A * 3/1995 Owens ..... 156/89.24
5,816,005 A * 10/1998 Han ..... 52/391
5,817,399 A * 10/1998 Kalman ..... 428/143
5,853,511 A * 12/1998 Fairbanks ..... 156/71
6,120,872 A * 9/2000 Deshon ..... 428/74
6,128,881 A * 10/2000 Bue et al. ..... 52/582.2
6,354,058 B1 * 3/2002 Lewis ..... 52/749.11
6,442,905 B1 * 9/2002 Weinstein ..... 52/34
6,647,684 B1 * 11/2003 Gank ..... 52/385
6,694,689 B1 * 2/2004 Scott et al. ..... 52/392

* cited by examiner

*Primary Examiner*—Naoko Slack
*Assistant Examiner*—Chi Q. Nguyen
(74) *Attorney, Agent, or Firm*—Fulbright & Jaworski LLP

(57) ABSTRACT

Disclosed are systems and methods which provide durable and substantially smooth surfaces comprised of a number of smaller pieces of surfacing material. For example, tiles of natural materials, such as marble or granite, are formed into larger unitary structures, wherein the surfaces of the tiles are substantially dead flat and the seams therebetween are diminished in size so as to minimize their visual impact. These unitary structures are preferably adapted to interconnection to thereby allow formation of substantially larger surfaces. Jig apparatus and methods for there use are disclosed for casting unitary structures of various shapes and configurations in such a manner that a dead flat surface with very little to zero lippage is provided.

39 Claims, 5 Drawing Sheets

SYSTEM AND METHOD FOR FORMING SURFACES USING TILED COMPONENTS AND PRODUCT RESULTING THEREFROM

TECHNICAL FIELD

The invention relates generally to surfacing materials and, more particularly, to providing unitary structures from tiled components for use as surfaces such as counters, walls, partitions, and floors.

BACKGROUND OF THE INVENTION

Surfacing materials have been used in the building industry for a number of decorative and functional purposes for years. Natural and manmade surfacing material has been used to provide decorative and/or durable surfaces upon countertops, floors, tub and shower enclosures, partitions, and building facades. For example, often it is desirable to provide a durable, e.g., water and/or heat resistant, surface which is decorative as a kitchen countertop.

Natural stone has been widely accepted as an attractive and durable surfacing material, such as for use in the aforementioned kitchen countertop. Specifically, a large slab of natural stone, such as marble or granite, may be cut to the dimensions of a kitchen countertop to provide a smooth, attractive, and durable surface. However, such a slab generally is required to be relatively thick, such as on the order of 1⅛$^{th}$ inch (approximately 3 cm) thick in order to provide sufficient resistance to breaking. Slabs of such material are typically very expensive as well as very heavy and difficult to handle. For example, the weight of a typical slab utilized in a kitchen countertop application will require at least 2 installers to handle the material, further adding to the costs associated therewith. Moreover, fabrication of a desired surface may require relatively large cutouts to be formed in the slab, such as to accommodate a kitchen sink or a built-in range, creating areas at which such a slab is prone to breakage even with slabs of 1⅛$^{th}$ inch thickness.

The use of such slabs in vertical facades is problematic because of their weight and the way in which they are typically attached to the supporting structure. Accordingly, smaller slabs, such as on the order of 2 feet by 2 feet, have been used in providing commercial facades. Although applied in a tile pattern, such smaller slabs are generally not considered as tiles. Specifically, as with the larger slabs discussed above, the 2 by 2 slabs must be relatively thick, such as on the order of 1⅛$^{th}$ thick or perhaps as thin as ¾$^{th}$ inch, to provide sufficient strength to allow handling without excessive breakage. Accordingly, such smaller slabs remain quite heavy and unwieldy for an individual to install.

A common technique for installation of such slabs involves drilling holes in the slabs for the application of copper wire tiebacks, resulting in a very time consuming and labor intensive installation process as well as a resulting surface appearance highly dependent upon the skill of the particular installer. For example, the small slabs stacked to make a commercial facade may provide a visibly uneven surface caused by slight misalignment of the face surfaces during installation.

Although much smaller pieces of natural materials, such as 12 inch by 12 inch tiles, are commonly available, such products have been generally undesirable for many surfacing applications. For example, the tiles are generally individually applied to a substrate, such as plywood, cement board, or water resistant sheet rock, using thin set or a mastic resin, trowel laid with the tile placed and spaced manually on a job site. This results in a surface which is not dead flat, is very labor intensive and highly variant depending upon the installer. Moreover, such an installation requires that a grout be applied to the tiles, to fill in the space between the tiles after it has been set with the thin set. The resulting grout lines, in addition to further contributing to the lack of a dead flat surface, are visually very apparent and are generally undesirable in many situations. For example, grout tends to stain easily and is difficult to clean. Moreover, it is difficult to keep a good solid seal from moisture with grout such that, over a period of time, water tends to leak through to the substrate and cause rotting of the subsurface and/or heaving of the tile veneer.

The use of tiles for providing surfacing does have advantages associated therewith, however. For example, because of their small size, even highly veined marble may be provided in relatively thin tiles, such as on the order of ⅜$^{th}$ inch. This provides for a much lighter surfacing material as compared to the aforementioned slabs of 1⅛$^{th}$ or ¾$^{th}$ inch thickness. Moreover, as less material is used, such tiles are typically much less expensive per square foot of area covered.

Accordingly, a need exists in the art for systems and methods providing durable surfaces with consistent results from installer to installer. Moreover, a need exists in the art for such surfaces to be provided with a minimum of labor and yet provide very smooth substantially dead flat surfaces.

BRIEF SUMMARY OF THE INVENTION

The present invention is directed to systems and methods which provide durable and substantially smooth surfaces comprised of a number of smaller pieces of surfacing material. According to a preferred embodiment, tiles of natural materials, such as marble or granite, are formed into larger slabs or other unitary structures, wherein the surfaces of the tiles are substantially dead flat and the seams therebetween are diminished in size so as to minimize their visual impact. These resulting unitary structures are preferably adapted to interconnection to thereby allow formation of substantially larger surfaces with predictable and consistent results irrespective of the skill level of the installer. Moreover, preferred embodiments provide slabs which, although relatively large in size, are lighter than traditional slabs of similar surfacing material, due to the use of thinner tiles being used. Preferably, such unitary structures include the use of a backer material which not only provides desired rigidity to prevent breakage of the surfacing material, but also facilitates the installation thereof in a variety of building applications.

According to a preferred embodiment of the present invention, natural stone tile is placed in a jig, or similar tile placement structure, in such a manner that a dead flat surface with very little to zero lippage is provided with respect to the individual tiles. Preferably, the jig provides a vacuum, or other movement restraint, to hold the relative positions of the individual tiles for their being affixed into a unitary structure according to the present invention. For example, according to a most preferred embodiment, tiles are placed face down on a vacuum bed platen, and may be placed against a fence on one or more sides, and held in place such that their faces are substantially flat with respect to one another and with a slight gap therebetween for the introduction of a fastening means.

Instead of using a grout compound between the joints of the tiles as is typical in prior art applications using such tiles, preferred embodiments of the present invention utilize a resin, such as a polyurethane, polyester, urethane, epoxy, or other resin, introduced to the edges of the individual tiles to be joined to thereby provide a fastening means as well as to provide substantially impermeable seams. Preferably, the resin utilized is tinted or otherwise adapted to provide a good color blend with respect to the tiles being joined to thereby result in the seams between the joined tiles having diminished visual impact. Embodiments of the invention may utilize adhesives other than resins, such as silicon based adhesives, if desired.

Additionally, the aforementioned resin is preferably applied to the back surfaces of the tiles to provide strength and/or durability. For example, a fiberglass mesh may be bedded in the resin on the back surfaces of the tiles for added strength and reinforcement of the assembly. Additionally or alternatively, a backer, such as may be utilized for providing the unitary structure mechanical bonding, strength, and/or setting advantages, may be attached to the tiles using the aforementioned resin. Moreover, the resin may provide a water barrier between the tiles and the backer and/or other material disposed behind the unitary structure when installed, such as wall studs, sheet rock, etcetera.

Backer material disposed upon the unitary structure of preferred embodiments of the present invention provide various advantages. Preferably, unitary structures of the present invention are adapted to facilitate interlocking to thereby simplify installation of large surfaces in the field. For example, 2 foot by 2 foot slabs (or slabs of any desired size) may be manufactured according to the present invention with offset backers such that a portion of backer material of one slab may be affixed to another slab and, thus, provide rigid interlocking of multiple slabs to form a large smooth surface.

Unitary structures of the present invention are preferably adapted for attachment to support structure of particular installations. For example, slots or other receivers may be disposed in the backing material to accept hangers. Such hangers may be attached to support structure such as wall studs or wall board, for example, and preferably provide adjustment to allow a flat, level, and plumb surface to be erected using the unitary structures of the present invention. Additionally or alternatively, the backer material may be adapted, such as by including perforations or other surface irregularities, to accept adhesives. Accordingly, slabs of the present invention may be affixed to surfaces, such as cement block walls or other sufficiently flat surfaces, using an appropriate application of adhesive, such as a 5 point butter application of mastic.

According to one embodiment, unitary structures made from tiles according to the present invention are prefabricated and provided for use in various construction projects. For example, the slabs of the present invention are lighter weight than a 2 foot by 2 foot $3/4^{th}$ inch or $1\frac{1}{8}^{th}$ inch slab of solid natural material and, therefore may be more easily handled and shipped. Accordingly, supply of such slabs may be premanufactured, palleted, and shipped for a single installer to handle and install the slabs to provide a desired surface on sight.

Moreover, the unitary structures may be provided as a substantially fungible product which is centrally made and distributed at various outlets, such as builder supply and home improvement stores. Accordingly, individuals may select a type and number of slabs needed for a particular installation and assemble the slabs, such as by taking advantage of the aforementioned interlocking and/or fastening features thereof, to provide a desired surface. Accessories, such as may also be unitary structures of the present invention, may be provided for use with such slabs, such as finished edge pieces, corner pieces, back splashes, etcetera to provide further flexibility with respect to the applications in which the slabs may be utilized. Such accessories may utilize the aforementioned interlocking design to provide a finished product that is both strong and appears unitary.

Accordingly, embodiments of the present invention provide durable surfaces with consistent results from installer to installer. Moreover, unitary structures of preferred embodiments of the present invention provide durable surfaces with a minimum of labor and yet provide very smooth substantially dead flat surfaces.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWING

For a more complete understanding of the present invention, reference is now made to the following descriptions taken in conjunction with the accompanying drawing, in which.

DETAILED DESCRIPTION OF THE INVENTION

Figure 1A:
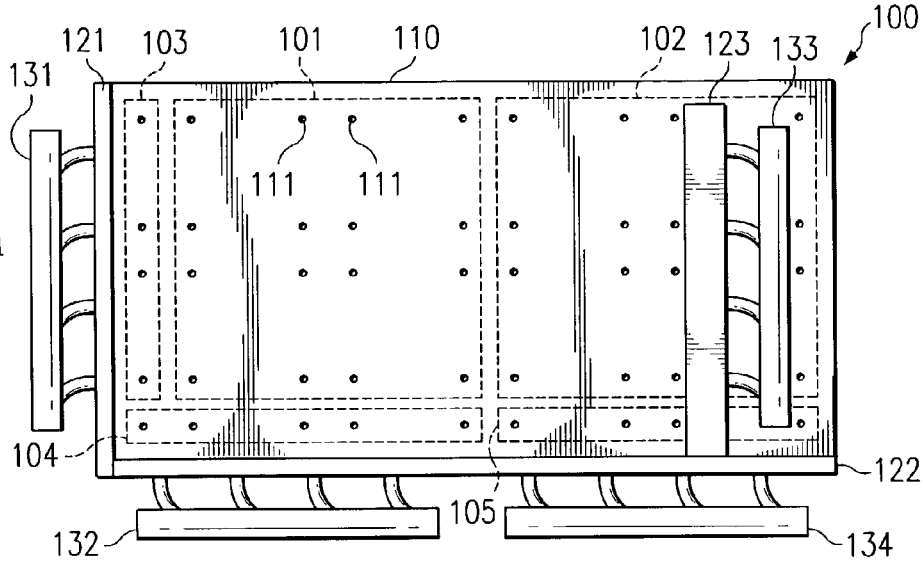
FIGS. 1A–1C show a vacuum jig according to a preferred embodiment of the present invention.
Figure 1B:
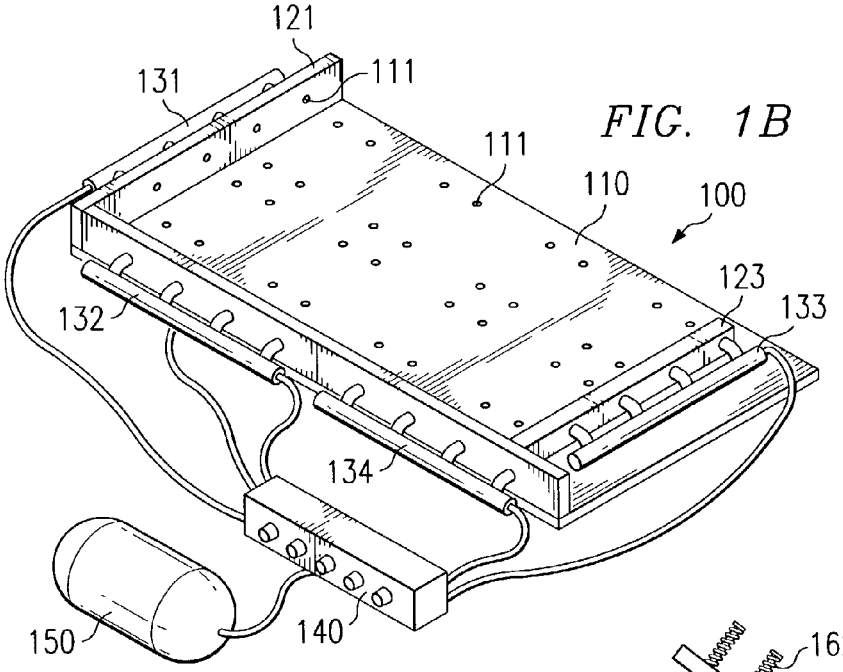
Figure 1C:
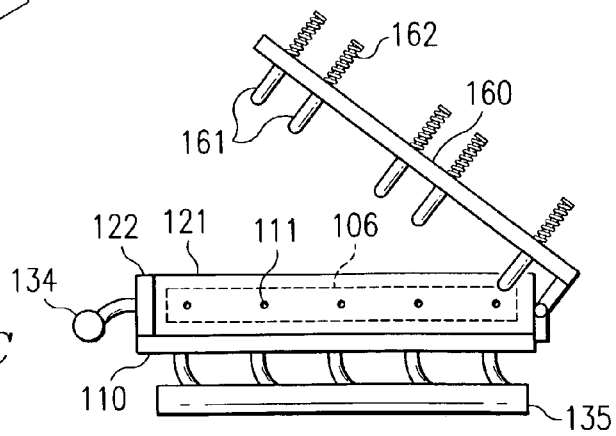

FIGS. 1A–1C show various views of preferred embodiment vacuum jig 100 utilized to hold individual tiles, such as natural marble, granite, or other tiles, and/or other individual pieces for providing a unitary structure of a desired size and configuration according to the present invention. Vacuum jig 100 of the illustrated embodiment includes platen 110, stationary fences 121 and 122, and adjustable fence 123. Also included in the illustrated embodiment of vacuum jig 100 are vacuum holes 111, vacuum pump 150, valve manifold 140, and vacuum reservoirs 131–135, associated with corresponding selectable zones of vacuum holes 111, e.g., zones 101–106. Embodiments of vacuum jig 100 may include clamp 160 having members 161 biased by springs 162.

In operation according to a preferred embodiment, platen 110 provides support for tiles and/or other individual pieces during processing according to the present invention. Preferably, platen 110 provides a dead flat surface upon which faces of the aforementioned tiles and/or other pieces may be held to result in a substantially dead flat slab face, i.e., no lippage associated with seams between the tiles and/or other individual pieces being formed according to the present invention. Platen 110 is preferably coated or otherwise provided with a surface which discourages adhesion of resins or other adhesives utilized in affixing the individual pieces into a slab or other unitary structure according to the present invention. Moreover, the surface of platen 110 is preferably adapted to facilitate the adjusting of positions of individual pieces as described herein, even with a slight vacuum applied according to particular embodiments described herein.

Stationary fences 121 and 122 preferably provide rigid and precisely oriented surfaces useful for establishing relative positions of individual pieces used in forming a unitary structure. Stationary fences 121 and 122 of the illustrated embodiment are disposed orthogonal with respect to platen 110 and with respect to one another to thereby provide a 90° corner and associated surfaces for forming a slab of precise square or rectangular geometries from a number of individual pieces. For example, individual tiles may be placed against stationary fences 121 and 122 to provide two straight sides and one 90° in a unitary structure produced according to the present invention. Orientation control of individual pieces provided through the use of such fences may be relied upon to provide very smooth edges and accurate corners with respect to the free sides of the unitary structure, such as where individual tiles are used which have relatively accurate and predictable geometries. However, further control with respect to precise orientation of surfaces may be provided by additional fences, such as adjustable fence 123, if desired.

Additionally or alternatively, the aforementioned fences may be utilized in application of particular pieces to edges of the unitary structure, such as to provide a drop-down edge for a countertop. Accordingly, moveable fence 123 may be utilized in conjunction with stationary fences 121 and 122 to produce a countertop having a drop-down edge on the front and both sides, for example.

It should be appreciated that although referred to herein as stationary, stationary fences utilized according to the present invention may be movable and/or removable, such as by manual or automatic means, e.g., hydraulic or pneumatic actuation. For example, stationary fences 121 and 122 may be attached to platen 110 by a hinge means to thereby allow their stationary disposal in positions as shown in FIG. 1 and their movement to expose a cast unitary structure, such as to facilitate removal thereof. Similarly, stationary fences 121 and 122 may attach to platen 110 using removable fastening means, such as screws, pins, clips, brads, snaps, etcetera, to thereby allow their stationary disposal in a desired position as well as their removal from platen 110. The use of such movable/removable stationary fences may be advantageous not only to facilitate removal of cast unitary structures, but also for facilitating cleaning of vacuum jig 100.

Vacuum holes 111 are provided in vacuum jig 100 of the illustrated embodiment to introduce a vacuum to surfaces of the aforementioned tiles and/or other pieces and, thereby, provide a holding force thereto. Vacuum holes 111 are preferably disposed in a predetermined pattern to accept the pattern of tile or other pieces used in forming a desired unitary structure. Specifically, as resins or other adhesives are utilized according to preferred embodiments of the present invention in adhering the aforementioned individual pieces together, vacuum holes 111 of the preferred embodiment are disposed in platen 110 and fences 121–123 to correspond with faces of individual pieces as they are positioned in the overall unitary structure. Accordingly, the placement of vacuum holes 111 of the preferred embodiment avoids or minimizes the opportunity of an adhesive fluid from being drawn down onto the face of the individual pieces through the seams therebetween. Avoidance of such adhesive creep to the face of the tiles, and thus the face of the unitary structure, of the preferred embodiment is useful in providing a dead flat surface upon the resulting unitary structure. Specifically, if adhesive material were to be drawn through a seam to the face of an individual tile, the edge of the tile may be forced from the platen as the adhesive accumulates and/or cures in that area. Moreover, avoidance of such adhesive creep to the face of the tiles is useful in lessening clean-up with respect to the cast unitary structure and/or vacuum jig.

Vacuum is preferably provided by vacuum pump 150 and is distributed to vacuum holes 111 disposed in platen 110, stationary fences 121 and 122, and adjustable fence 123 of the illustrated embodiment by valve manifold 140 and various vacuum reservoirs, e.g., reservoirs 131–135, associated with particular selectable zones of vacuum holes 111, e.g., zones 101–106. Accordingly, valve manifold 140 provides multiple vacuum lines feeding vacuum holes disposed in the fences and platen of vacuum jig 100. Vacuum reservoirs 131–135 of the illustrated embodiment are preferably utilized in providing a uniform vacuum to a number of vacuum holes of a corresponding zone. Accordingly, a valve of valve manifold 140 may be in communication with each vacuum hole of a particular zone via one or more vacuum reservoirs.

Figure 4:
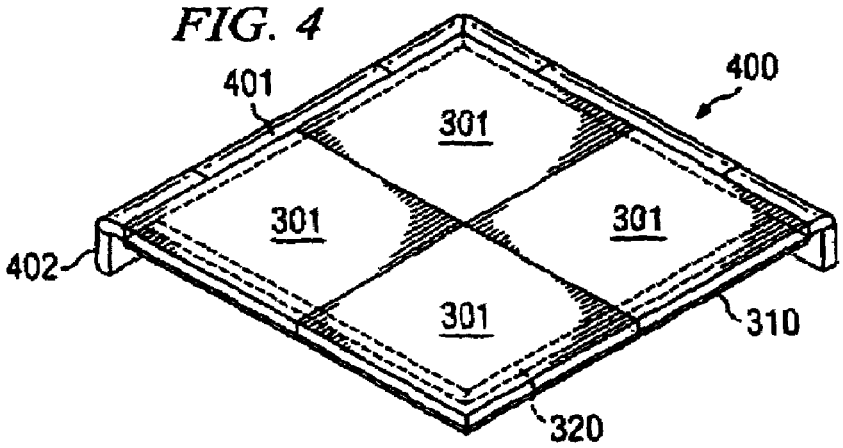
FIG. 4 shows a unitary structure including a drop-down edge according to a preferred embodiment of the present invention.

In operation, valves may be selected corresponding to areas where tiles or other pieces to form the unitary structure are present and need to be held firmly to reduce the possibility of the resins from seeping underneath the face of the tile and/or to retain the dead flatness of the resulting unitary structure. For example, a valve associated with only zone 101 may be selected where a small slab is being produced having no edge border pieces and no drop-down pieces. However, valves associated with zones 101, 103, 104, and 106 as well as a zone of fence 122 (not shown, but substantially corresponding to zone 104) may be selected where a small slab is being produced having edge border and drop-down pieces on the front and right sides of the resulting unitary structure (see e.g., FIG. 4). Similarly, valves associated zones 102 and 122, a zone of fence 122 (not shown, but substantially corresponding to zone 105), and/or a zone of fence 123 (not shown) may additionally or alternatively be selected as needed, such as where a larger slab is being produced. Therefore, it should be appreciated that the vacuum to specific areas of vacuum jig 100 may be enabled/disabled as they are needed, thereby allowing flexibility with respect to the size and configuration of unitary structures which may be formed therefrom.

Embodiments of vacuum jig 100 may be further adapted to retain the relative position of individual pieces, such as for use during curing of an adhesive resin. For example, a clamping mechanism, such as clamp 160 shown hingedly affixed to platen 110 in FIG. 1C, may be provided for holding individual tiles and/or other pieces against platen 110 and/or fences 121–123. According to the illustrated embodiment, pressure is asserted against various individual pieces by members 161 as biased by springs 162. Preferably, members 161 are disposed to correspond with the aforementioned vacuum hole locations. Accordingly, clamping pressure will be provided to correspond with appropriate surfaces of the individual pieces, rather than gaps therebetween. Moreover, the positioning of such members to correspond to the vacuum holes of the platen may facilitate properly perforating a release sheet disposed upon the platen by operation of the clamp through an close and open cycle.

Having described a preferred embodiment of vacuum jig 100, its configuration and use in forming unitary structures, for such applications as countertops, from commonly available tiles will be described below. It should be appreciated that 12 inch by 12 inch tiles of approximately $\frac{3}{8}^{th}$ inch thickness are widely available in such materials as marble and granite. Accordingly, such tiles may be utilized in providing unitary structures according to the present invention. For example, such tiles may be utilized whole for providing the main body of such a unitary structure. Additionally or alternatively, such tiles may be cut to desired sizes and/or shapes, such as to provide drop-down edges, back splashes, etcetera, if desired.

Countertops commonly utilized in the building industry in the United States are typically on the order of 25½inches deep. Moreover, such countertops are typically provided with a 1½inch drop-down along exposed front edges and sides. Accordingly, the aforementioned 12 inch by 12 inch tiles may be arranged 2 tiles deep to provide the main body of a countertop created according to the present invention. Additionally, strips of the tile material, such as may be cut from the tiles, may be turned on end to provide a drop-down of a desired thickness. For example, strips of material may be cut which are approximately $1\frac{1}{4}^{th}$ inch for use in providing a drop-down edge of a unitary structure of the present invention. According to a most preferred embodiment, pieces of such $1\frac{1}{4}^{th}$ inch material are placed along an edge of the aforementioned 12 inch by 12 inch tiles arranged 2 tiles deep to provide an edge border (see e.g. FIG. 4), thereby resulting in a countertop surface of approximately $25\frac{1}{4}^{th}$ inches deep. Additionally, pieces of such $1\frac{1}{4}^{th}$ inch material are placed upon their edge on the under side of the edge border pieces to thereby provide a drop-down. As the thickness of the preferred embodiment tile material is approximately $\frac{3}{8}^{th}$ inch, the resulting drop-down will be approximately $1\frac{5}{8}^{th}$ inch.

Preferably, the vacuum hole spacing of vacuum jig 100 is designed, as discussed above, for the particular tile to be used and/or the configuration of the resulting unitary structure. Some vacuum holes 111 of the preferred embodiment are disposed in platen 110 in such a manner as to provide 4 vacuum ports per 12 inch by 12 inch tile of the main body of the unitary structure formed. Similarly, some vacuum holes 111 of the preferred embodiment are disposed in platen 110 and fences 121–123 in such a manner as to provide 2 vacuum ports per 12 inch by $1\frac{1}{4}^{th}$ inch edge border and drop-down piece. The preferred embodiment vacuum hole configuration provides a multi-point system that draws each tile down evenly and provides good contact between the face of the tile and platen 110.

It should be appreciated that a number of vacuum holes may be disposed in platen 110 and/or fences 121–123 for use with particular layouts of individual pieces. For example, vacuum holes may be positioned to accommodate diamond insets disposed in place of the 4 corners of the tiles of the main body. Accordingly, when such a pattern is desired, appropriate valves upon valve manifold 140 may be adjusted to activate vacuum holes positioned for holding diamond insets and/or to deactivate vacuum holes positioned for holding the removed corners of the main body tiles. Similarly, vacuum holes may be disposed and controllably selectable for use in additional or alternative patterns, such as checkerboard patterns, herringbone patterns, racetrack striping patterns, and the like. Accordingly, vacuum jigs of the present invention may comprise vacuum holes disposed in patterns other than that illustrated and/or disposed to accommodate a plurality of patterns.

Preferably the vacuum holes are located a sufficient distance from each edge of the tile or other pieces to prevent or minimize their drawing adhesives to the face of the tiles. For example, the vacuum holes of the preferred embodiment are located approximately 2.5 inches in from each edge of each tile. Similarly, the vacuum holes of the preferred embodiment are located approximately 2.5 inches from the ends and centered with respect to the sides of the edge border and drop-down pieces.

Disposing the vacuum holes offset with respect to the seams provides advantages in addition to preventing or mitigating the creeping of adhesive material to the face of the individual pieces. By having 2.5 inches offset with respect to the tile edges, a tile does not have to be initially placed precisely in the jig. For example, a tile may be placed roughly into position, a slight vacuum applied to ensure a dead flat surface configuration, and the tile adjusted up to $\frac{3}{4}^{th}$ to 1 inch in any direction while still maintaining a good vacuum pulling the tile to the platen.

It should be appreciated that a vacuum jig having vacuum holes disposed as described above may be utilized to form a number of unitary structure configurations. For example, offset fences may be placed against fences 121 and 122 and utilized to properly orient 12 inch by 12 inch tiles over the aforementioned vacuum holes when edge border and/or drop-down pieces are not to be used with respect to a unitary structure (e.g., a simple slab is to be made). Such offset fences may be approximately $1\frac{1}{4}^{th}$ inch deep to cover the vacuum holes used with edge border pieces and may be made out of metal, plastic, or acrylic, for example, and provided with a coating, such as PVC or silicone, to provide features similar to that discussed below with respect to coating the platen and fences. Offset fences of a preferred embodiment are described in further detail with reference to FIG. 6 below.

The surfaces of the platen and fences that come into contact with the tiles and other pieces forming the unitary structure are preferably coated to provide desired interfacing attributes with respect thereto. For example, the platen and fences may be provided with a resilient coating, such as a rubber coating, either PVC or vinyl, of approximately $\frac{1}{16}^{th}$ inch thick. Such a coating provides a good vacuum seal between the tile surface and the platen itself. Moreover, such a coating may be utilized in preventing adhesive material from adhering to the platen or fences of vacuum jig 100. Additionally, coatings of the preferred embodiment allow the positioning, such as by sliding, of individual pieces with a slight vacuum, such as on the order of 3 to 4 psi, applied thereto. Accordingly, the individual pieces may be held substantially dead flat loosely positioned, such as for the introduction of adhesive material to the edges to be joined, and then the pieces slit into their precise positions for curing of the adhesive to provide a desired unitary structure. It should be appreciated that lubricants, such as talc or graphite, may be applied to the platen, fences, and/or tile piece faces to facilitate the aforementioned repositioning.

Additionally or alternatively, release coatings or sheets may be applied to the platen and/or fence surfaces, if desired. For example, a release sheet, such as paper (e.g., butcher paper, kraft paper, etcetera) with or without a release agent (e.g. wax, KELGIN, etcetera), may be laid upon platen 110, perhaps to be held in place through movement of stationary fences 121 and/or 122 into their desired stationary position, prior to laying out the pieces of a unitary structure. Of course, it may be desirable to provide perforations in such a release sheet, such as by pre-punching holes, corresponding to the aforementioned vacuum holes. It should be appreciated that the use of such release sheets may be advantageous in facilitating release of a cast unitary structure from the vacuum jig and/or for clean-up. For example, the release sheet may simply be removed and discarded and a new release sheet installed for a second casting using the vacuum jig.

The platen and/or fences of the preferred embodiment vacuum jig may be further adapted to provide desired functionality according to the present invention. For example, platen 110 may be heated, such as by inclusion of electrically operated heating elements upon the underside thereof, to decrease the time required for curing adhesives.

Similarly, vacuum jigs of the present invention may include adaptation to provide desired functionality according to the present invention. For example, the size of a vacuum jig of the present invention may be quite large and/or provide areas for forming multiple unitary structures simultaneously, such as for use in a large manufacturing process.

Figure 2:
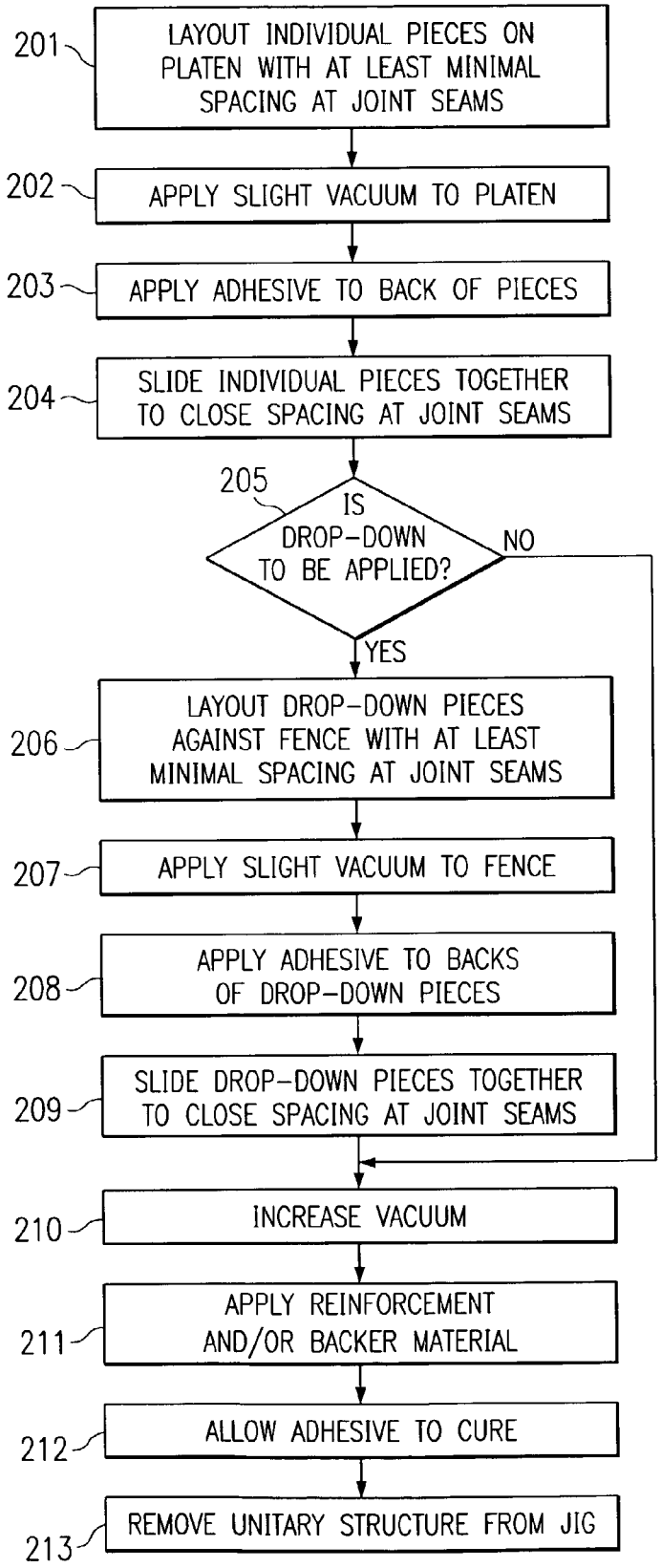
FIG. 2 shows a flow diagram of steps for casting a unitary structure using the vacuum jig of FIGS. 1A–1C according to a preferred embodiment of the present invention.

Directing attention to FIG. 2, a preferred embodiment flow diagram of steps performed in producing a unitary structure using the aforementioned vacuum jig are shown. At step 201 individual pieces utilized to form the unitary structure are preferably laid out face down upon platen 110. For example, if edge border pieces are to be included, those pieces are laid out against fences 121, 122, and/or 123, as appropriate. However, if edge border pieces are not be included, one or more offset fences are disposed against fence 121 and/or fence 122, as appropriate. Tile pieces of the main body are also preferably laid out upon platen 110. Preferably, an amount of space, such as on the order of $1/16^{th}$ inch, is left between the edges of each of the individual pieces.

At step 202 a slight vacuum, such as 3 to 4 psi, is preferably applied to the pieces laid upon platen 110, such as by manipulating appropriate ones of the valves of valve manifold 140 to place vacuum pump 150 in communication with vacuum reservoirs corresponding to appropriate ones of the vacuum holes. As mentioned above, a slight vacuum is applied according to the preferred embodiment in order to hold the individual pieces substantially dead flat, while allowing them to be moved, such as by sliding, for precise placement after the application of adhesive material. Of course, it should be appreciated that such a vacuum may be applied when the individual pieces are initially placed in communication with platen 110, allowing for sliding of the pieces to positions consistent with the aforementioned spacing between the edges, if desired.

At step 203 adhesive, such as an acrylic, polyester, or urethane resin, is preferably applied to the back surfaces of the individual pieces. The application of such adhesive material preferably introduces adhesive material to the aforementioned gap between the edges of the individual pieces to be joined. Accordingly, adhesive is preferably applied to the back surfaces thereof at least in the area of these gaps. For example, adhesive material may be squeegeed, sprayed, brushed, and/or extruded upon the back surfaces along these gaps to facilitate flowing of such adhesive into the gaps. Preferably, the adhesive material is colored or tinted to coordinate with the color of the tile material in order to lessen the visual impact of the seams and or any adhesive material visible therein.

Preferred embodiments of the present invention provide for durable and/or water resistant unitary structures. Accordingly, the aforementioned adhesive material is preferably applied as a coating to the entire back surface of the individual pieces. Such an application of adhesive according to the preferred embodiment serves several purposes. For example, the adhesive material, such as the aforementioned resins, may be water resistant and, thus, form a seamless water impermeable layer upon the back of the individual pieces. Accordingly, even porous natural materials, having a tendency to wick moisture, may be prevented from allowing water to come into contact with underlying structure, such as backer material, wall board, framing studs, etcetera. Moreover, the application of such adhesive over the back surface may facilitate attachment of structural elements, such as fiberglass mat, backer material, and/or the like. Likewise, the application of such adhesive may be utilized in attaching portions of the unitary structure, such as the aforementioned drop-down pieces.

At step 204 of the illustrated embodiment, the individual pieces are slid together to close the aforementioned gaps between the edges. For example, all of the pieces may be slid slightly toward fences 121 and/or 122 to close these gaps while maintaining a clean edge/orthogonal corner defined by the fences. Preferably, the adhesive material in the gaps is caused to completely fill any space remaining between the individual pieces by the compression thereof. However, due to the holding down of the individual pieces dead flat against platen 110 by the aforementioned vacuum, no or minimal adhesive material is allowed to creep to the face of the individual pieces, according to the preferred embodiment.

The closing of these gaps after the introduction of the adhesive serves to ensure a good application of adhesive between the individual pieces, both for good adhesion as well as for providing a good seal against water and/or particulate infiltration. Moreover, minimizing the size of this gap serves to minimize the visual impact thereof.

At step 205 a determination is made as to whether drop-down pieces, or other additional individual pieces, are to be added to the casting to form the desired unitary structure. If no additional individual pieces are to be added, processing according to the illustrated embodiment proceeds to step 210. However, if additional individual pieces are to be added to the casting, processing according to the illustrated embodiment proceeds to step 206.

At step 206 the drop-down pieces, or other additional individual pieces, are laid out in the appropriate orientation.

For example, if drop-down edges are desired, individual drop-down edge pieces are laid out with their face against fences 121, 122, and/or 123 with a side of the drop-down edge piece in communication with the aforementioned adhesive material.

At step 207 a slight vacuum, such as 3 to 4 psi, is preferably applied to the pieces laid out along the fences, such as by manipulating appropriate ones of the valves of valve manifold 140 to place vacuum pump 150 in communication with vacuum reservoirs corresponding to appropriate ones of the vacuum holes. As mentioned above, a slight vacuum is applied according to the preferred embodiment in order to hold the individual pieces substantially dead flat, while allowing them to be moved, such as by sliding, for precise placement after the application of adhesive material. Of course, it should be appreciated that such a vacuum may be applied when the individual pieces are initially placed in communication with platen 110, allowing for sliding of the pieces to positions consistent with the aforementioned spacing between the edges, if desired.

At step 208 the adhesive applied to the backs of the pieces laid out upon platen 110 is preferably applied to the back surfaces of the additional individual pieces. The application of such adhesive material preferably provides adhesive material within the aforementioned gap between the edges of the individual pieces to be joined and/or to facilitate attachment of structural elements thereto, such as the aforementioned fiberglass mat and/or backer material. Accordingly, adhesive is preferably applied to the back surfaces thereof at least in the area of these gaps. However, the aforementioned adhesive material is preferably applied as a coating to the entire back surface of the additional individual pieces, substantially as described above with respect to the individual pieces laid out upon platen 110.

At step 209 the individual pieces are preferably slid together to close the gaps between the edges. For example, all of the drop-down edge pieces may be slid slightly downward toward the back sides of the individual pieces laid out upon platen 110 to close these gaps while maintaining a clean edge/orthogonal corner defined by the fences. Preferably, the adhesive material in the gaps is caused to completely fill any space remaining between the individual pieces by the compression thereof. However, due to the holding down of the additional individual pieces dead flat against respective ones of fences 121–123 by the aforementioned vacuum, no adhesive material is allowed to creep to the face of the individual pieces, according to the preferred embodiment.

The closing of these gaps after the introduction of the adhesive serves to ensure a good application of adhesive between the individual pieces, both for good adhesion as well as for providing a good seal against water and/or particulate infiltration. Moreover, minimizing the size of this gap serves to minimize the visual impact thereof.

At step 210 the vacuum may be increased, such as to 5 psi or above, to reduce the chance of movement by one or more of the individual pieces during further processing and/or curing of the adhesive. It should be appreciated, however, that increasing of the vacuum is not required according to the present invention and, therefore, may be omitted, if desired.

After the gaps are closed, structural and/or mechanical components are added to the back of the tiles at step 211 according to a preferred embodiment. For example, a fiberglass mesh or other structural component may be pressed into the adhesive material to provide strength. Preferably, such a fiberglass mesh is applied across all the aforementioned seams, including those associated with the attachment of any drop-down edge pieces to a corresponding slab surface, to thereby provide added strength thereto. Additional adhesive material may be applied to the aforementioned fiberglass mesh or other structural component, such as to fully saturate the fibers thereof and thereby provide a very rigid element upon curing of the adhesive.

Additionally or alternatively, backer material, such as a rigid backer board, may be applied to the back of the tiles at step 211 to provide added strength, thickness, mechanical attachment points, interlocking structure for attachment of additional unitary structures of the present invention, and/or the like. For example, a rigid backer board may be pressed into the adhesive already present upon the back surfaces of the individual pieces. Alternatively, additional adhesive or a different adhesive may be applied to the back surfaces of the individual pieces and/or a backer board for attaching to the unitary structure. Preferred embodiment backers are discussed in further detail with respect to FIGS. 3A–3C below.

At step 212 the adhesive is allowed to cure. Curing of the adhesive may comprise setting the casting aside and awaiting the appropriate amount of time. Alternatively, additional action may be taken to expedite the curing of the adhesive and/or to ensure the unitary structure produced has desired attributes. For example, the platen assembly may be heated and/or moved into an oven to decrease adhesive curing times. Additionally or alternatively, mechanisms, such as clamp 160 discussed above, may be employed to ensure that the individual pieces and other components of the casting do not alter position during curing of the adhesive. Such a clamp mechanism may be particularly useful where a backer has been applied to ensure that good adhesion is obtained between the backer material and the remaining parts of the unitary structure. Such a mechanism may be adapted to allow air or heat to flow across the back side of the casting to aid in curing the adhesive.

At step 213, a resulting unitary structure is removed from the vacuum jig. The vacuum jig may then be utilized again in producing additional unitary structures according to the steps described above. The resulting unitary structure may be further processed, such as to finish (e.g., polish) exposed edges of tiles, remove any adhesive material that may have wept onto an exposed surface thereof, etcetera.

Figure 3A:
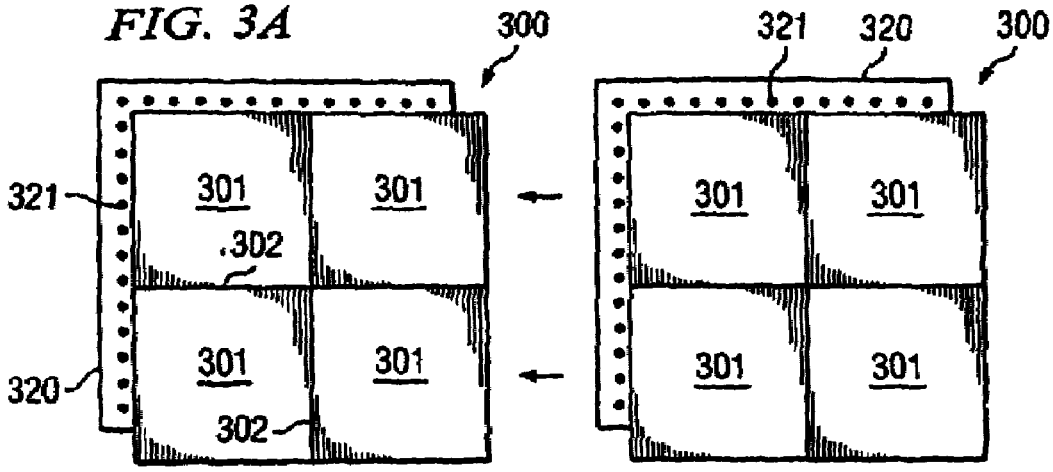
FIGS. 3A–3C show slab unitary structures cast according to a preferred embodiment of the present invention.
Figure 3B:
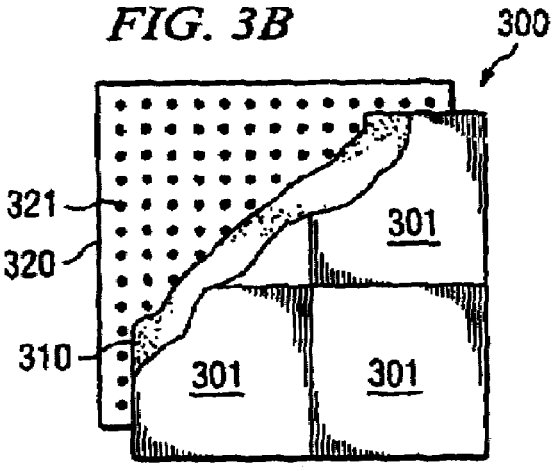
Figure 3C:
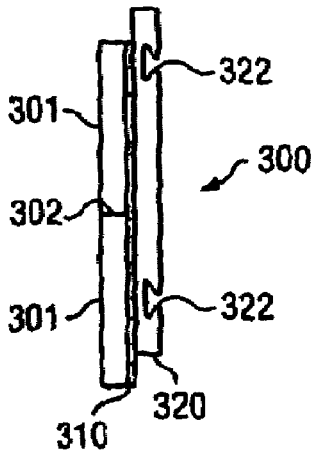

FIGS. 3A–3C show 2 foot by 2 foot unitary structures 300, such as may be produced according to the steps of FIG. 2 using vacuum jig 100 of FIGS. 1A–1C. It should be appreciated that unitary structures 300 each comprise 4 12 inch by 12 inch tiles 301, fiberglass mesh 310, and rigid backers 320. Specifically, fiberglass mesh 310 is preferably sandwiched between tiles 301 and rigid backers 320 as shown in FIG. 3C, preferably using an adhesive resin, as described above. Seams 302 can be seen between tiles 301.

Edge border pieces and drop-down edge pieces are not included in unitary structures 300 as illustrated in FIGS. 3A–3C, although such pieces may be included along one or more edges thereof according to embodiments of the present invention. Directing attention to FIG. 4, unitary structure 400 is shown configured substantially as unitary structures 300, but further including edge border pieces 401 and drop-down edge pieces 402 disposed along 2 sides thereof. Such edge pieces may be added when casting the unitary structure as described above. Moreover, according to a preferred embodiment of the present invention, such edge pieces may be produced separately for later attachment as needed, as discussed in further detail with respect to FIGS. 8 and 9 below. It should be appreciated that such edge pieces may be formed from a number of separate pieces, such as edge border pieces 401 and drop-down edge pieces 402, or formed from a solid piece of material. For example, a length of stone material, such as in a 2 foot length to avoid breakage, may be cut in an "L" shaped profile to thereby provide a unitary structure having an edge border surface corresponding to edge border piece 401 and a drop-down edge surface corresponding to drop-down edge piece 402.

Directing attention again to FIGS. 3A–3C, it should be appreciated that, although substantially the same size and shape as the assembled tiles 301 of unitary structure 300, backer 320 is offset, such as on the order of ½ inch along 2 sides of the unitary structure. This provides an interlocking system between separate unitary structures to facilitate assembly of larger surfaces. For example, adhesive material may be applied to an exposed portion of backer 320 and the unitary structures moved together, such as in the direction of the arrows in FIG. 3A, such that the offset edge of a backer of one unitary structure is disposed behind tiles of another unitary structure and adhered thereto. This overlapping of a backer with respect to a seam between multiple unitary structures results in a mechanically strong seam.

The exposed edges of backer 320 resulting from the offset may be utilized in additional or alternative applications, such as to provide an easily accessible attachment point or points. For example, a screw or screws may be driven through exposed portions of backer 320 to attach unitary structure 300 to underlying structure, such as wall studs or the like. Such fastening means may be utilized as a primary means for attaching the unitary structure to underlying structure or may be utilized to supplement other attachment means. For example, unitary structure 300 may be attached to an underlying structure through application of adhesive, such as in a 5 point back-buttering technique, and a screw or screws through backer 320 used to hold a desired position during curing of the adhesive. It should be appreciated that due to the offset configuration of unitary structures 300, interlocking ones of such unitary structures may be applied after fastening a first unitary structure to underlying structure, thus covering the exposed backer and any fastening means associated therewith.

Figure 9:
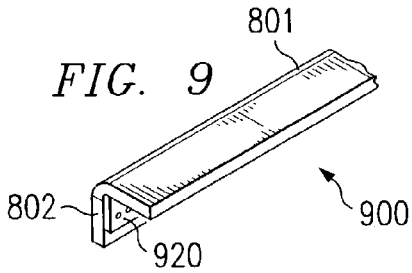
FIG. 9 shows a unitary structure cast using the vacuum jig of FIG. 8.

According to a preferred embodiment, the exposed edges of backer 320 resulting from the offset are sized to accommodate a prefabricated finished edge, such as an edge made from the aforementioned 1¼$^{th}$ inch wide material with or without the aforementioned drop-down edge pieces (see e.g. FIG. 9). This allows for unitary structures of the present invention to be assembled to a desired size and to have their edges finished off as desired. For example, a flat finished edge might be installed in a shower application whereas a drop-down finished edge might be installed in a countertop application.

Multiple backer materials and configurations may be utilized according to the present invention. For example, the backer of the illustrated embodiment provides a perforated configuration, having holes 321 disposed therein, to facilitate mechanical bonding of materials and/or to provide ventilation to aid in the curing of adhesives used therewith. Backer 320 may be comprised of a pegboard material, such as on the order of ¼$^{th}$ inch thick, according to a preferred embodiment. The perforations of such a backer material helps to provide a mechanical bond when the adhesive creeps up into the holes on the backer. With holes disposed through such a backer material, the backer provides such mechanical bonds both with respect to the backer being adhered to the other components of the unitary structure as well as with respect to the unitary structure being adhered to other structure.

Backer materials which might be utilized according to the present invention include the aforementioned pegboard material (e.g., a low pressure laminate material), high pressure laminates, wood, plywood, pressboard, strand board, fiber board, cement board, plastic, metal, and composites. The selection of a particular material may be based upon such considerations as water resistance, rigidity, weight, thickness, and/or adhesion characteristics. Of course, a particular material may be selected based upon a desire to provide a particular characteristic and be adapted to provide other characteristics to an acceptable degree. For example, a plastic sheet material may be selected to provide a light and water resistant backer, although such a material may not be particularly well suited to bonding with adhesive agents used. The plastic sheet may be perforated, such as by drilling holes therein, perhaps at various angles, to provide an improved mechanical bond with adhesive resins.

It should be appreciated that the backers of the preferred embodiment provide strength and thickness to the unitary structure without substantially increasing its weight. Accordingly, a unitary structure of the present invention may be provided which may be used in place of the aforementioned relatively thick slabs of natural material without having the weight and expense of such relatively thick slabs. Moreover, the unitary structures of the present invention provide more strength, such as when a cutout for a sink or other large opening, is disposed therein.

Additional advantages over the aforementioned relatively thick slabs are realized by the present invention in a variety of installations. For example, in commercial installations there is typically one inch to 2 inches of space between the finished surface and the wall that it is being applied to, whether it is a cinder block wall, a stud wall, a sheet rock wall, etcetera. This space has traditionally been used to allow for the relatively thick slabs of marble or other natural material to be set dead plumb. This dead plumb construction provides stability with respect to such a finished surface as these slabs must be set dead plumb so that all the weight of each of the slabs is supported by the slabs below it. If the finished surface, or any of the slabs used therein, leans in or out the strength is lost and the weight of the slab material exerts a force to make the finished surface topple over.

Using unitary structures of preferred embodiments of the present invention, the weight of ones of the unitary structures may be borne by other ones of the unitary structures in the finished surface. However, there is less weight involved in constructing the aforementioned finished surface from relatively thick slabs of material and, therefore, a finished surface provided according to the present invention is less dependent upon a dead plumb orientation for stability.

Moreover, other features may be disposed in the backers of the present invention for use in particular installations. For example, slots 322 may be disposed in backer 320 to accept mechanical tie backs for fastening unitary structure 300 to particular structure, such as a cinder block wall, a stud wall, etcetera.

Figure 5A:
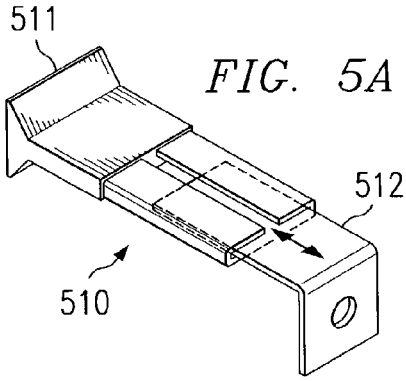
FIGS. 5A and 5B show mechanical tie backs according to embodiments of the present invention.
Figure 5B:
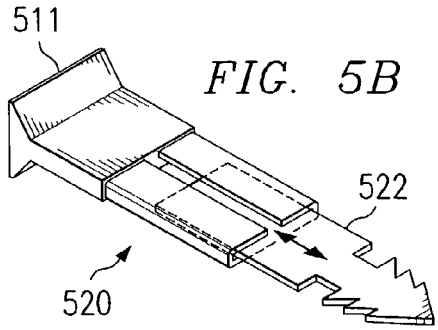

Directing attention to FIGS. 5A–5B various embodiments of mechanical tie backs useful with unitary structure 300 are shown. Specifically, mechanical tie back 510 of FIG. 5A provides base portion 511 adapted to slidably engage any of slots 322 disposed in backer 320. Mechanical tie back 510 further provides "L" bracket attachment member 512 adapted for fastening to a wall, such as a cinder block wall, or other surface, such as sheet rock, a stud face, plywood, etcetera. Preferably base 511 and attachment member 512 provide an adjustable interface to allow adjusting in the direction of the arrows. Accordingly, base 511 may be slid into a slot 322 to a proper position corresponding to an attachment point on a structure, such as to align with a stud. Attachment member 512 may be fastened to the structure, such as by nail, screw, and/or adhesive. Such fastening may occur prior to or after interfacing attachment member 512 with base 511, as desired. With attachment member 512 fastened to the structure and interfaced with base 511 engaged in slot 322, unitary structure may be adjusted for plumb by adjusting the interface of base 511 and attachment member 512 in the direction of the arrows. Once proper adjustment is achieved, the position may be maintained by fixing the interface between base 511 and attachment member 512, such as by crimping, tightening a fastener, and/or applying an adhesive.

An alternative configuration of a mechanical tie back is shown in FIG. 5B. Specifically, mechanical tie back 520 of FIG. 5B utilizes base portion 511 adapted to slidably engage any of slots 322 disposed in backer 320, consistent with mechanical tie back 510 discussed above. However, mechanical tie back 520 provides barbed attachment member 522 adapted to penetrate material, such as wood, gypsum, plaster, and plastic, for fastening thereto. Accordingly, mechanical tie back 520 may be driven into supporting structure for fastening and adjusting for plumb as described above. As shown by the arrows in FIGS. 5A–5B and discussed above, the standoff distance between the head of base portion 511, which slidably engages slots 322, and the section of either attachment member 512 or barbed attachment member 522 which engages an installation surface may be adjusted. Thus, mechanical tie back 510 provides an adjustable mechanical standoff.

Of course, a number of other mechanical tie back means may be utilized according to the present invention. The above described mechanical tie back means are merely exemplary of the features which may be incorporated therein and the particular uses to which they may be put. An alternative mechanical tie back configuration may remain adjustable and/or removable after installation. Accordingly, a temporary decorative wall might be installed, such as is common in malls where a store is being remodeled, and removed as desired. The unitary structures and/or mechanical tie backs may be used again and again as needed.

It should be appreciated that use of mechanical tie back systems are not required to provide a plumb surface using unitary structures according to the present invention. For example, the previously mentioned 5 point butter technique may be utilized in providing fastening and adjustment for plumb. Specifically, an installer may apply a liberal amount of a thick quick set epoxy mastic at each corner and in the middle of the unitary structure. Such an application of epoxy may be utilized to bridge the gap or hollow space, such as 1 to 2 inches, between the finished surface and the supporting structure. The unitary structure may be adjusted for plumb by compressing the epoxy at the appropriate positions and, thereafter, the unitary structure held plumb for few minutes until the epoxy sets.

Figure 6:
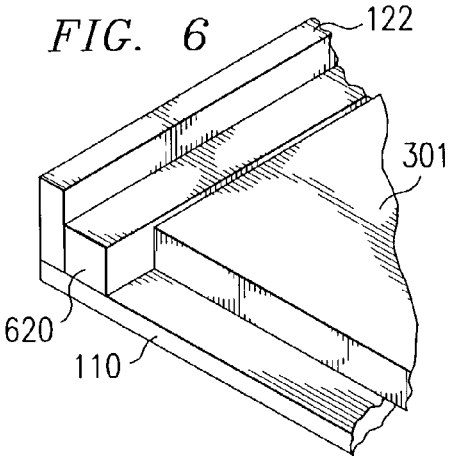
FIG. 6 shows an offset fence utilized in a vacuum jig according to a preferred embodiment of the present invention.

FIG. 6 shows the use of an offset fence in laying up a unitary structure according to a preferred embodiment of the present invention. Specifically, offset fence 620 is shown disposed between tile 301 and stationary fence 122, as may be used where border edge pieces are not to be included in the unitary structure. For example, offset fence 620 may be laid in place over the vacuum holes where edge pieces might otherwise lay. Offset fence 620 may be made from a number of materials, such as metal, plastic, or acrylic. Preferably offset fence 620 is coated, such as with rubber, PVC, or silicone coating, so that adhesive resins will not adhere to it, as discussed above with respect to platen 110 and fences 121–123.

Figure 7:
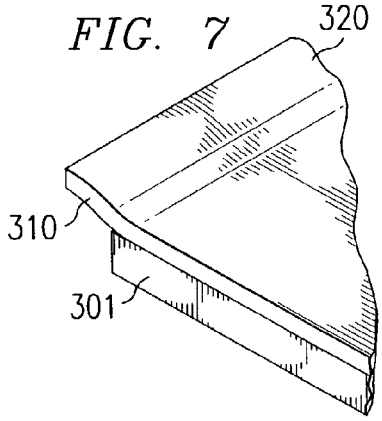
FIG. 7 shows a unitary structure cast using the offset fence of FIG. 6.

Offset fence 620 of the preferred embodiment is slightly larger in thickness than is the tile used therewith. For example, where $\frac{3}{8}^{th}$ inch thick tile is being used in a unitary structure, offset fence 620 may be approximately $\frac{1}{16}^{th}$ inch thicker or about $\frac{7}{16}^{th}$ inch thick. This configuration is designed to hold the offset backer of the preferred embodiment a slight distance off of the back of the tile to provide flexibility in attaching interlocking pieces. The exposed end of backer 320 held a slight distance off of the back of tile 310 from use of offset fence 620 is shown in FIG. 7.

Tile typically will vary up to $\frac{1}{32}$nd inch in thickness, depending upon the supplier it comes from, the production lot from which it came, etcetera. The slight lifting of the backer off of the back of the tile at the exposed edges allows tiles of slightly different thickness to be accommodated when interlocking multiple unitary structures of the present invention. This feature can be particularly important in situations where a pattern of different tile is used, such as may incorporate tiles from different manufactures or different production runs. Moreover, this feature may also be relied upon to accommodate variances in the thickness of adhesive resins applied to the backs of the tiles according to the present invention.

Figure 8:
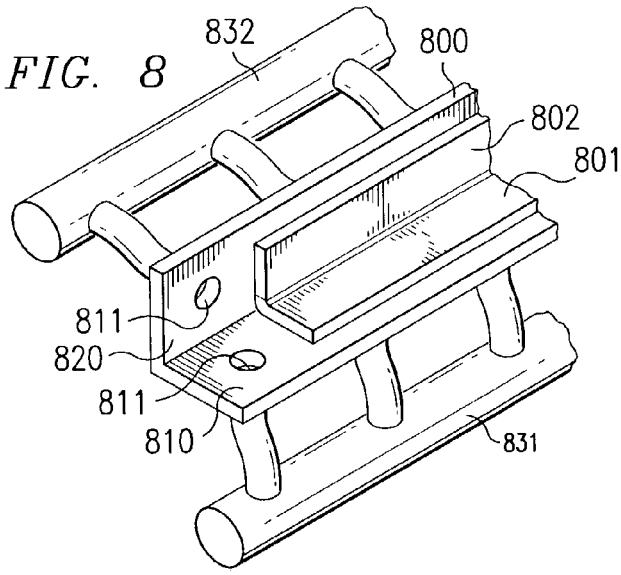
FIG. 8 shows a vacuum jig according to an alternative embodiment of the present invention.

FIG. 8 shows an alternative embodiment vacuum jig of the present invention. Specifically, vacuum jig 800 of FIG. 8 provides a 90° angle vacuum jig such as may be utilized in providing drop-down edge unitary structures. Vacuum jig 800 of the illustrated embodiment includes platen 810 and stationary fence 820, such as may be formed from a piece of 2 inch angle iron. Also included in the illustrated embodiment of vacuum jig 800 are vacuum holes 811 and vacuum reservoirs 831–832, associated with corresponding selectable zones of vacuum holes 811, as may be coupled to a vacuum pump and/or valve manifold as described above with respect to vacuum jig 100. Preferably, the surfaces of platen 810 and fence 820 coming into contact with individual pieces used to form a unitary structure of the present invention are covered with a coating, such as rubber, silicone, or PVC, as described above.

According to the illustrated embodiment, vacuum holes 811 are disposed throughout platen 810 and fence 820 at positions relative to the edges of the individual pieces as described above. Preferably, edge border pieces (e.g., edge border piece 801) and drop-down edge pieces (e.g., drop-down edge piece 802), such may be $1\frac{1}{4}^{th}$ inch wide strips of natural material as described above, are placed in vacuum jig 800, vacuum applied, adhesive applied, gaps between the pieces closed, and reinforcing material and/or backers applied consistent with the preferred embodiment steps of FIG. 2. However, according to a preferred embodiment, a backer is applied only to the back of the drop-down edge pieces in order to leave the edge border piece free to accept the exposed portion of backer material of another unitary structure of the present invention.

For example, unitary structure 900 (FIG. 9) cast from use of vacuum jig 800 includes perforated backer 920 disposed upon the back of drop-down edge piece 802. Preferably, backer 920 is positioned to engage not only the back side of drop-down edge piece 802, but the edge of backer 920 also engages a portion of the back side of edge border piece 801 to further strengthen the seam between these two individual pieces. However, the back of edge border piece is free to receive an exposed portion of backer 320 of unitary structure 300.

Accordingly, unitary structures of different sizes, shapes, colors, and configurations may be produced according to the present invention for use together. A home improvement store, for example, may stock a number of slab unitary structures, such as unitary structure 300, and a number of drop-down edge unitary structures, such as unitary structure 900, to allow individuals to purchase the amount of material needed for a variety of construction projects which, when assembled, appear to be custom fit for the application. For example, an installer may lay a countertop using a number of 2 foot by 2 foot slab unitary structures 300, where slabs are interlocked using the offset backer as described above. Similarly, front and/or side edges of the countertop may be finished by interlocking a number of drop-down unitary structures 900. Corners may be addressed by cutting the drop-down unitary structures 900 at 45° angles, as is well known in the art.

The slab unitary structures and/or drop-down unitary structures may be fastened together using a number of techniques. For example, a polyester resin, such as is commonly used in solid surface and granite countertop installations, may be mixed to color match the tile material of the unitary structure. This resin may be applied to the seams, backer boards, and/or backs of the unitary structures and the structures assembled.

It should be appreciated that one or more unitary structures may be specifically adapted for use in a particular application, if desired. For example, in a countertop application, unitary structures may be adapted to accept installation of an under mounted sink. Accordingly, such unitary structures may include a portion wherein, instead of a backer material, a double layer of tile material is applied providing an approximately $\frac{3}{4}^{th}$ inch thick area where a sink is to be installed. A hole corresponding to the sink may be cut and the edges of the unitary structure polished and the sink under mounted as desired.

According to an embodiment of the invention, a vacuum jig, or portion thereof, may be provided in a movable unit thereby allowing it to be moved according to the steps of a casting process. Preferably, some reduced set of the components of the above vacuum jig are utilized in a movable platen assembly with one or more host stations providing additional aspects of the aforementioned vacuum jig, to thereby provide a configuration in which a large number of relatively small and/or economical platen assemblies may be provided for large scale casting of unitary structures. For example, a platen assembly may be moved into a specified casting location and hooked up with quick connect couplers to a vacuum pump and/or other services that are designated for that casting location. Thereafter, a unitary structure may be laid up at the casting station, whether by robotic means or human hands. The platen assembly may then be removed, after disconnection of the vacuum pump and/or other services, for curing of the adhesive while another platen assembly is placed at the casting station for lay up of another unitary structure.

Figure 10:
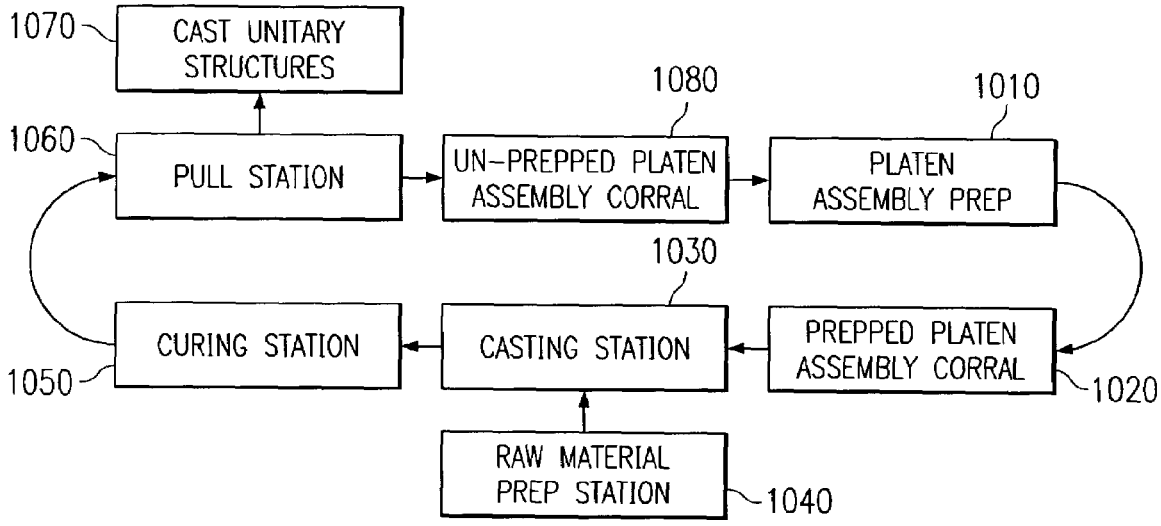
FIG. 10 shows a block diagram of a casting process according to a preferred embodiment of the present invention.

Directing attention to FIG. 10, a block diagram of a unitary structure casting process using the aforementioned movable platen assemblies is shown. In the casting process of FIG. 10, various stations are provided for conducting steps associated with producing a preferred embodiment unitary structure. The arrows illustrated in FIG. 10 represent movement means, such as roller bed assemblies, conveyers, robotic arms, human interaction, and/or the like, utilized to translate items between the various stations. Preferably platen assemblies of the present invention are translated between ones of the various stations using the aforementioned roller bed assemblies. For example, a platen assembly may be translated to a particular station upon rollers of a roller bed assembly and, when disposed in a desired position such as by reaching a stop fence, rollers may be retracted, such as by hydraulic or pneumatic means, to leave the platen assembly firmly positioned. Various services may be coupled to the platen assembly and/or actions taken with respect thereto, such as to lay up pieces of a unitary structure. Thereafter, the rollers of the roller bed assembly may again be distended and the stop fence retracted for the platen assembly to be translated to a next station.

Referring to FIG. 10, a unitary structure casting process may begin at station 1010 wherein a platen assembly is prepped. Preferably the platen assembly is one of a plurality of platen assemblies, as may be stored in an un-prepped platen assembly corral of station 1080. Prepping of the platen assembly may comprise cleaning the platen assembly parts, such as to remove adhesives and/or a release sheet, disposing stationary fences and/or adjustable fences in desired positions, etcetera. Where a release sheet does is not preperforated to provide communication of vacuum pressure from the platen to pieces disposed therein, prep of the platen assembly may further comprise punching appropriate holes in such a release sheet. According to a preferred embodiment, members of a clamp assembly, such as members 11 of clamp 160, are disposed to correspond with the platen vacuum holes, thereby facilitating the punching of the desired holes by closing the claim upon the platen and again opening the clamp. Thereafter, the prepped platen assembly may be stored for use, such as in a prepped platen assembly corral of station 1020.

As needed, a platen assembly may be moved from station 1020 to station 1030 for lay up and casting of a unitary structure. The platen assembly may be coupled to various services, such as a vacuum pump, provided by station 1030 for use in casting. Raw materials, such as tiles, backer boards, adhesives, etcetera, may be provided to station 1030 from station 1040 where they have been prepped for use in the casting process. The raw materials may be disposed in the proper positions upon the platen assembly, as described above, and various other casting steps performed, such as increasing vacuum pressure at a particular time, adjusting adjustable fences, employing a clamping mechanism, etcetera. After casting a unitary structure, the platen assembly may be moved from station 1030 to station 1050, to thereby allow another platen assembly to occupy station 1030 for casting.

Station 1050 may provide a curing station for curing of the cast unitary structure. Curing may comprise "racking" a plurality of platen assemblies for sufficient time to allow the cast unitary structure to obtain a desired level of rigidity before further handling. The platen assemblies may be coupled to various services, such as a heat or power source, provided by station 1050. Additionally or alternatively, the platen assemblies may be placed in a curing incubator means, such as a drying oven, to promote rapid or controlled curing.

After a cast unitary structure has achieved a desired level of curing, the platen assembly may be moved from station 1050 to station 1060 for removal of the cast unitary structure from the platen assembly. Removal of the cast unitary structure may comprise moving stationary fences and/or adjustable fences from a casting position to a position to facilitate removal of the cast unitary structure, releasing a clamping mechanism, etcetera. The removed cast unitary structure may be moved to station 1070 for further processing and/or storage. The platen assembly, having had the cast unitary structure removed therefrom, may be moved to station 1080, such as may provide an un-prepped platen assembly corral.

Although the embodiment of FIG. 10 shows particular stations, it should be appreciated that the present invention is not limited to the use of the particular stations shown. For example, the un-prepped platen assembly corral of station 1080 and prepped platen assembly corral of station 1020 may be omitted where casting and prep stations provide sufficient throughput to keep abreast of the use of the platen assemblies.

Using the vacuum jigs of the present invention for casting unitary structures as described herein provides many advantages over traditional installation techniques used with respect to natural tiles and/or slabs. For example, manufacturing such unitary structures in a shop environment allows for better controls both with respect to quality, e.g., consistency in the end product, providing a dead flat surface, matching adhesives to material colors, etcetera, and cost, e.g., materials may be purchased and used in bulk, waste can be better controlled, etcetera.

It should be appreciated that unitary structures of the present invention may be made from a number of materials in addition to the aforementioned natural marble and granite, as well as combinations thereof. For example, an acrylic insert of a comparable thickness to the tile can be put in place. This could be done to imbed a decorative piece, such one displaying a company name or logo in the unitary structure for a commercial business application. Additionally or alternatively, decorative accents may be included, such as diamond inserts of various materials and/or colors.

Preferably, materials having substantially flat faces are utilized in providing unitary structures according to the present invention in order to provide a dead flat surface and/or to prevent adhesives from migrating to the face of the unitary structure during casting. It should be appreciated that tiles, such as the aforementioned commercially available granite and marble tiles, often have a very slight bevel at the edges thereof. Although this bevel has not been found to result in significant amounts of adhesive migrating to the face of the tiles during casting, it does result in a visible seam between the tiles. Accordingly, embodiments of the present invention may utilize tiles without such a bevel, such as might be specifically made for use according to the present invention, to further minimize the visual appearance of such seams.

Although preferred embodiments have been described herein in providing countertops, it should be appreciated that the present invention is not so limited. For example, in addition to countertops, unitary structures of the present invention may be utilized in providing decorative wall surfacing, enclosures (such as shower enclosures), dividers (such as restroom stall dividers), flooring, and the like.

The unitary structures of the present invention are particularly well suited for use in flooring applications where there is settling, flexing, or movement of the subfloor, such as in pier and beam construction. The unitary structures themselves provide very strong and durable seams between the individual pieces utilized therein. Moreover, the interlocking of multiple unitary structures according to the preferred embodiment provides very strong and durable seams between the unitary structures themselves.

Another application particularly well suited for use of unitary structures of the present invention is a commercial floating floor application, such as where a metal rail system is installed to support flooring material several inches over a subfloor. Unitary structures of the present invention may be configured to rest upon the rail system, providing sufficient strength to support the weight typically placed upon such floors, and allowing sections to be lifted or pulled up to access cables, phone wire, computer ports, or whatever may lay underneath the floating floor.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. An interlocking surfacing system, said system comprising:

a first plurality of individual pieces of surfacing material arranged in a predetermined pattern to define a first composite surface, wherein said first plurality of individual pieces have an adhesive applied to a back surface thereof and at least a portion of said adhesive is disposed within seams between ones of said first individual pieces, wherein a first backer is provided with respect to said first composite surface coupled to a back surface thereof and disposed to provide an exposed first backer portion adapted to engage a second composite surface and wherein said first plurality of individual pieces comprise a plurality of tiles of a same shape and size; and a second plurality of individual pieces of surfacing material arranged in a predetermined pattern to define said second composite surface, wherein said second plurality of individual pieces have an adhesive applied to a back surface thereof and at least a portion of said adhesive is disposed within seams between ones of said second individual pieces, wherein a second backer is provided with respect to said second composite surface coupled to a back surface thereof and disposed to provide a portion of said back surface of said second composite surface to accept said exposed first backer portion, and wherein said second plurality of individual pieces comprise edge pieces shaped differently than said first plurality of individual pieces.

2. The system of claim 1, wherein said first backer is offset with respect to said first plurality of individual pieces along edges thereof to accommodate variation in thickness of said second plurality of individual pieces.

3. The system of claim 2, wherein said individual pieces are approximately $\frac{3}{8}^{th}$ inch thick and said offset is approximately $\frac{1}{16}^{th}$ inch.

4. The system of claim 1, wherein said tiles are approximately 12 inches by 12 inches.

5. The system of claim 1, wherein said second plurality of individual pieces comprise a plurality of tiles of a same shape and size.

6. The system of claim 5, wherein said tiles are a same shape and size as tiles of said first plurality of individual pieces.

7. The system of claim 1, wherein said second plurality of individual pieces comprise border edge pieces disposed in a same plane with said first plurality of individual pieces when said first composite surface and said second composite surface are interlocked.

8. The system of claim 1, wherein said second plurality of individual pieces comprise drop-down edge pieces disposed in a different plane from said first plurality of individual pieces when said first composite surface and said second composite surface are interlocked.

9. The system of claim 1, wherein said first composite surface and said second composite surface are part of larger number of composite surfaces providing fungible slabs of surfacing material for assembly by interlocking.

10. The system of claim 9, wherein said larger number of composite surfaces comprises slabs of varying attributes.

11. The system of claim 10, wherein said varying attributes comprise different colors.

12. The system of claim 10 wherein said varying attributes comprise different patterns.

13. The system of claim 10, wherein said varying attributes comprise different materials.

14. The system of claim 10, wherein said varying attributes comprise different sizes.

15. The system of claim 10, wherein said varying attributes comprise different shapes.

16. The system of claim 1, wherein said first composite surface is part of a first larger number of composite surfaces providing fungible slabs of surfacing material for assembly by interlocking, and wherein said second composite surface is part of a second larger number of composite surfaces providing fungible finishing portions of surfacing material for assembly by interlocking.

17. The system of claim 16, wherein said second larger number of composite surfaces provide drop-down edges for said first larger number of composite surfaces.

18. The system of claim 16, wherein said second larger number of composite surfaces provide border edges for said first larger number of composite surfaces.

19. The system of claim 16, wherein said second larger number of composite surfaces comprises finishing portions of varying attributes.

20. The system of claim 19, wherein said varying attributes comprise different configurations of said predetermined patterns of said second plurality of individual pieces.

21. The system of claim 1, wherein said first backer is sized and shaped to substantially correspond to a size and shape of said first composite surface.

22. The system of claim 1, wherein said first backer is adapted to mechanically bond to said adhesive.

23. The system of claim 22, wherein said adaptation of said first backer comprises said first backer being perforated.

24. The system of claim 1, wherein said first backer is adapted to facilitate attachment of said first composite surface to a subsurface.

25. The system of claim 24, wherein said adaptation of said first backer comprises said first backer being perforated to mechanically bond with a mounting adhesive applied thereto.

26. The system of claim 24, wherein said adaptation of said first backer comprises said first backer having a fastener disposed at said exposed first backer portion to couple to said subsurface.

27. The system of claim 24, wherein said adaptation of said first backer comprises said first backer having a standoff attachment point defined thereon.

28. The system of claim 1, further comprising:

a plurality of mechanical standoffs adapted to couple to said first backer and a subsurface to which said first composite surface is to be attached.

29. The system of claim 28, wherein said mechanical standoffs are adjustable.

30. The system of claim 28, wherein said first backer is adapted for selectable placement of said mechanical standoffs.

31. The system of claim 30, wherein adaptation of said first backer comprises a slot disposed in a back surface of said first backer to receive a portion of said mechanical standoffs.

32. The system of claim 28, wherein said mechanical standoffs are removable from said first composite surface to allow reuse of said first composite surface after an initial installation.

33. The system of claim 1, wherein a reinforcing layer is disposed between said first backer and said first plurality of individual pieces.

34. The system of claim 33, wherein said reinforcing layer comprises a fibrous layer embedded into said adhesive applied to said back surface of said first plurality of individual pieces.

35. The system of claim 1, wherein said first plurality of pieces comprise commercially available tiles.

36. The system of claim 35, wherein said tiles comprise a natural surface.

37. The system of claim 36, wherein said natural surface comprises marble.

38. The system of claim 36, wherein said natural surface comprises granite.

39. An interlocking surfacing system, said system comprising:

a first plurality of individual pieces of surfacing material arranged in a predetermined pattern to define a first composite surface, wherein said first plurality of individual pieces have an adhesive applied to a back surface thereof and at least a portion of said adhesive is disposed within seams between ones of said first individual pieces, and wherein a first backer is provided with respect to said first composite surface coupled to a back surface thereof and disposed to provide an exposed first backer portion adapted to engage a second composite surface;

a second plurality of individual pieces of surfacing material arranged in a predetermined pattern to define said second composite surface, wherein said second plurality of individual pieces have an adhesive applied to a back surface thereof and at least a portion of said adhesive is disposed within seams between ones of said second individual pieces, and wherein a second backer is provided with respect to said second composite surface coupled to a back surface thereof and disposed to provide a portion of said back surface of said second composite surface to accept said exposed first backer portion; and a plurality of mechanical standoffs adapted to couple to said first backer and a subsurface to which said first composite surface is to be attached, wherein said mechanical standoffs comprise differently configured mechanical standoffs adapted for attachment to different subsurface materials.

* * * * *